United States Patent [19]

Koester

[11] Patent Number: 5,035,004

[45] Date of Patent: Jul. 30, 1991

[54] CAP AND MASK ORGANIZATION

[76] Inventor: Eric J. Koester, 433 Linda Ave., Beloit, Wis. 53511

[21] Appl. No.: 541,323

[22] Filed: Jun. 21, 1990

[51] Int. Cl.[5] ..... A42B 1/18

[52] U.S. Cl. ..... 2/206; 2/9; 2/10; 2/173; 2/199

[58] Field of Search ..... 2/9, 10, 173, 196, 199, 2/209.1, 209.2, 206, 424, DIG. 6

[56] References Cited

U.S. PATENT DOCUMENTS

| | | | |
|---|---|---|---|
| 891,122 | 6/1908 | Wilcox | 2/206 |
| 1,356,542 | 10/1920 | McNeill | 2/10 |
| 1,485,160 | 2/1924 | Bassan | 2/173 |
| 1,947,786 | 2/1934 | Lueck | 2/173 |
| 2,344,811 | 3/1944 | Gill | 2/173 |
| 2,462,258 | 2/1949 | Dannenberg | 2/10 |
| 2,964,757 | 12/1960 | Jarvis | 2/173 |
| 3,016,545 | 1/1962 | Donahue | 2/199 |
| 4,665,568 | 5/1987 | Stutes | 2/209.2 |
| 4,850,049 | 7/1989 | Landis | 2/9 |
| 4,853,974 | 8/1989 | Olim | 2/206 |
| 4,864,653 | 9/1989 | Landis | 2/9 |
| 4,945,458 | 7/1990 | Batts | 2/209.2 |
| 4,945,574 | 8/1990 | Dagher | 2/206 |
| 4,961,232 | 10/1990 | Hulsey | 2/206 |
| 4,964,171 | 10/1990 | Landis | 2/9 |

FOREIGN PATENT DOCUMENTS

| | | | |
|---|---|---|---|
| 625304 | 10/1927 | France | 2/10 |
| 1377550 | 9/1964 | France | 2/199 |
| 330681 | 7/1958 | Switzerland | 2/206 |
| 732248 | 6/1955 | United Kingdom | 2/10 |

*Primary Examiner*—Werner H. Schroeder
*Assistant Examiner*—Diana L. Biefeld
*Attorney, Agent, or Firm*—Leon Gilden

[57] ABSTRACT

An organization including a cap and a forwardly directed visor with a selectively securable open mesh fabric sheet of optically transparent characteristic defined by an open mesh web to permit visual observation through the sheet when mounted to the cap. The sheet further includes a pattern imparted upon the sheet in correlation with an associated team of a sporting event and the like. The invention may further include a further sheet that is coextensive with a perimeter defined by the cap to overlie an individual's head for minimizing interaction with insects and the like during a sporting event. Further, the invention may optionally include a fiber optic cable associated with a selectively illuminated light source to direct illumination of a fiber optic framework pattern directed about the pattern formed on the sheet to enhance visual observation of the pattern during conditions of limited available light.

3 Claims, 4 Drawing Sheets

PRIOR ART

CAP AND MASK ORGANIZATION

BACKGROUND OF THE INVENTION

1. Field of the invention

The field of the invention relates to cap organizations, and more particularly pertains to a new and improved cap and mask organization wherein the same provides selective securement of an overlying sheet to effect an operative relationship between individual and a sporting event.

2. Description of the Prior Art

Expressions of team enthusiasm during various sporting events are of increasing popularity in contemporary society. In an effort to visually illustrate individual enthusiasm in association with a sporting event, various modes of expression are utilized such as banners, placards and the like. The instant invention attempts to improve an individual's operative association with a sporting event by providing a sheet or mask-like arrangement that is of an optically transparent characteristic and includes a trademark and the like associated with a team during a sporting event.

Prior art mask type organizations may be found in U.S. Pat. No. 2,344,811 to GILL setting forth a cap structure utilizing a mask that is formed with a zippered association to an associated cap formed with a mesh fabric for purpose of insect repulsion.

U.S. Pat. No. 1,485,160 to BASSAN sets forth a cap and mask organization wherein a framework mounted to an individual's head pivotally secures a mask thereto.

U.S. Pat. No. 2,258,531 to BALDWIN sets forth an amusement device for children including an organization defined by a vehicular configuration to be worn about shoulders of a child for a child to simulate vehicular transport.

U.S. Pat. No. 1,947,786 to LUECK et al sets forth a reversible helmet mounting a shield selectively positionable to an associated helmet structure.

U.S. Pat. No. 3,717,882 to SCHUESSLER sets forth a cap including an adjustable face mask whose opening may be adjusted in relation to a face portion of an individual.

As such, it may be appreciated that there continues to be a need for a new and improved cap and mask organization as set forth by the instant invention which addresses both the problems of ease of use as well as effectiveness in construction in communicating sporting enthusiasm in association with various events.

SUMMARY OF THE INVENTION

In view of the foregoing disadvantages inherent in the known types of cap organizations present in the prior art, the present invention provides a new and improved cap and mask organization wherein the same utilizes a selectively securable sheet member formed of an open mesh optically transparent fabric sheet utilizing a super imposed team designation imparted upon the sheet. As such, the general purpose of the present invention, which will be described subsequently in greater detail, is to provide a new and improved cap and mask organization which has all the advantages of the prior art cap structures and none of the disadvantages.

To attain this, the cap and mask organization of the invention includes an organization including a cap and a forwardly directed visor with a selectively securable open mesh fabric sheet of optically transparent characteristic defined by an open mesh web to permit visual observation through the sheet when mounted to the cap. The sheet further includes a pattern imparted upon the sheet in correlation with an associated team of a sporting event and the like. The invention may further include a further sheet that is coextensive with a perimeter defined by the cap to overlie an individual's head for minimizing interaction with insects and the like during a sporting event. Further, the invention may optionally include a fiber optic cable associated with a selectively illuminated light source to direct illumination of a fiber optic framework pattern directed about the pattern formed on the sheet to enhance visual observation of the pattern during conditions of limited available light.

There has thus been outlined, rather broadly, the more important features of the invention in order that the detailed description thereof that follows may be better understood, and in order that the present contribution to the art may be better appreciated.

There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cap and mask organization which has all the advantages of the prior art cap and mask organizations and none of the disadvantages.

It is another object of the present invention to provide a new and improved cap and mask organization which may be easily and efficiently manufactured and marketed.

It is a further object of the present invention to provide a new and improved cap and mask organization which is of a durable and reliable construction.

An even further object of the present invention is to provide a new and improved cap and mask organization which is susceptible of a low cost of manufacture with regard to both materials and labor, and which accordingly is then susceptible of low prices of sale to the consuming public, thereby making such cap and mask organizations economically available to the buying public.

Still yet another object of the present invention is to provide a new and improved cap and mask organization which provides in the apparatuses and methods of the prior art some of the advantages thereof, while simultaneously overcoming some of the disadvantages normally associated therewith.

Still another object of the present invention is to provide a new and improved cap and mask organization which may be compactly stored when not being utilized.

Yet another object of the present invention is to provide a new and improved cap and mask organization wherein the same sets forth a cap structure utilizing a selectively mounted optically transparent member employing a team trademark pattern mounted upon the member.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
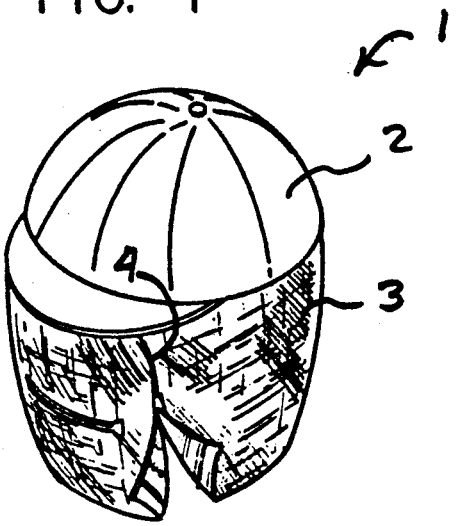
FIG. 1 is an isometric illustration of a prior art cap and mask structure.

With reference now to the drawings, and in particular to FIGS. 1 to 8 thereof, a new and improved cap and mask organization embodying the principles and concepts of the present invention and generally designated by the reference numeral 10 will be described.

Figure 2:
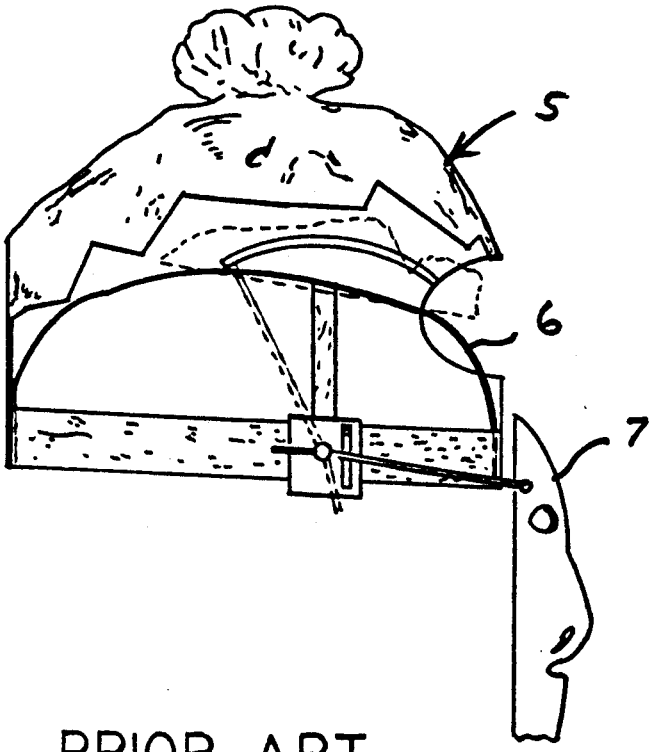
PRIOR ART FIG. 2
FIG. 2 is an orthographic side view partially in section of a further example of a prior art cap and mask structure.
Figure 3:
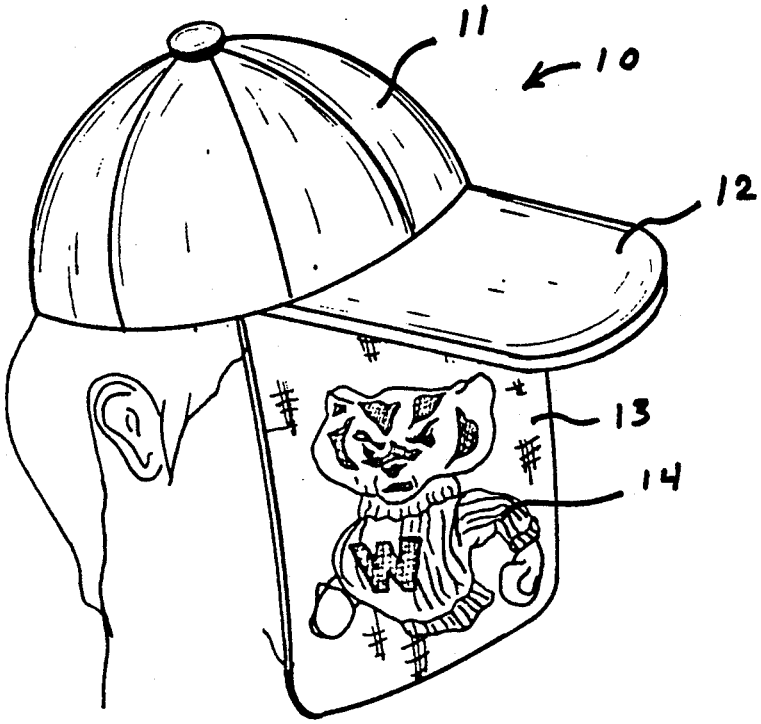
FIG. 3 is an isometric illustration of the instant invention.
Figure 4:
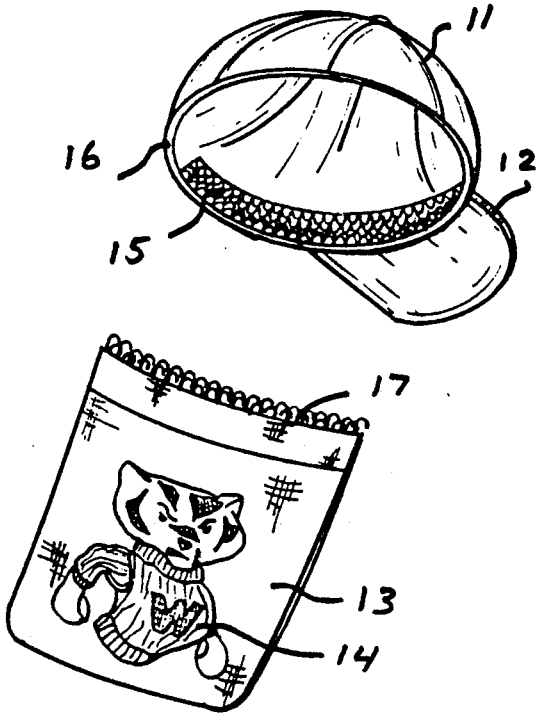
FIG. 4 is an isometric illustration of the instant invention in a disassembled configuration.

FIG. 1 illustrates a prior art cap and mask structure 1 wherein the cap member 2 includes a web 3 secured in surrounding relationship relative to the cap 2 utilizing a coextensive zipper 4. FIG. 2 illustrates a cap and mask structure 5 wherein a framework 6 pivotally mounts a mask 7 thereto.

More specifically, the cap and mask organization 10 of the instant invention essentially comprises a bowl shaped cap member 11 including a visor 12 projecting forwardly thereof relative to a continuous cap member lower edge 16. An open mesh fabric sheet 13 formed of an optically transparent open mesh material is provided including a pattern 14 imparted thereon.

The pattern 14 may be mounted to the web 13 or formed by a silk screening process or alternatively of a dyeing coloration procedure and the like. As understood the pattern 14 retains the optically transparent characteristic of the woven open mesh fabric sheet 13. The cap member 11 includes a first hook and loop fastener strip 15 mounted to an interior surface of the cap 11 adjacent to and in contiguous relationship to the lower edge 16 of a predetermined length. The visor 12 in its positioning relative to the cap 11 bisects the first hook and loop fastener strip 15 to symmetrically position the first hook and loop fastener strip 15 relative to the cap 11. The sheet 13 includes a second hook and loop fastener strip 17 mounted integrally to an upper terminal end edge of the sheet 13 wherein the first hook and loop fastener strip 15 and the second hook and loop fastener strip 17 are of an equal predetermined length to permit selective securement of the sheet in a secure manner relative to the cap 11.

Figure 5:
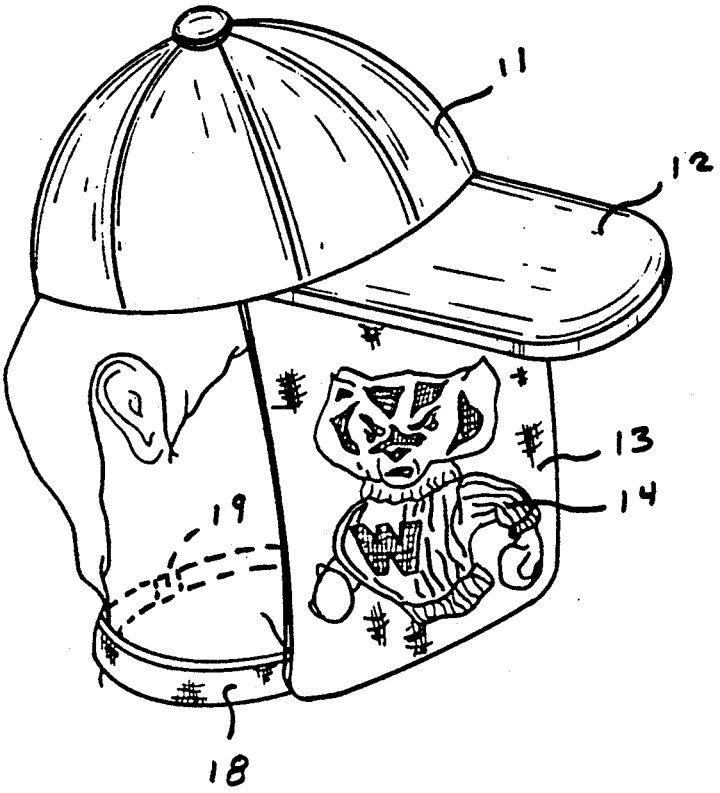
FIG. 5 is an isometric illustration of the instant invention employing a neck strap.
Figure 6:
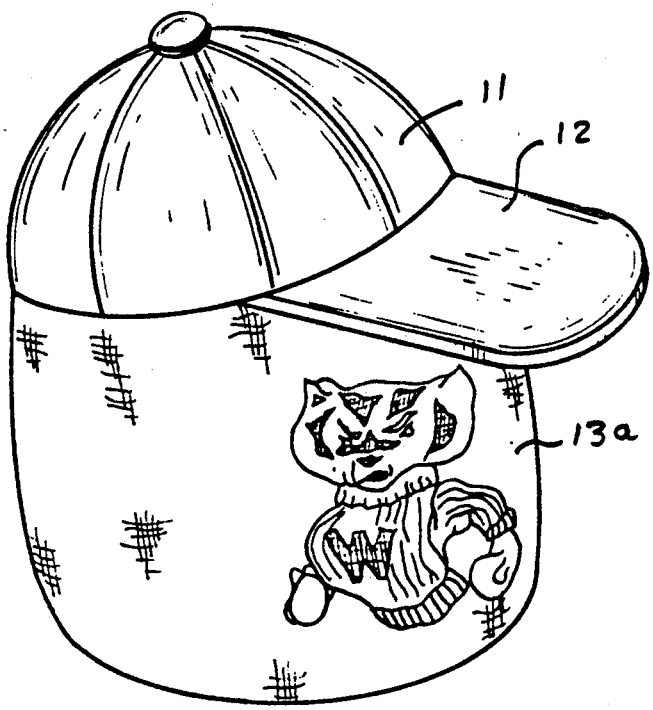
FIG. 6 is an isometric illustration of the instant invention utilizing a selectively mounted encircling sheet web.

FIG. 5 illustrates the use of the sheet 13 including a split lower neck strap 18 wherein each terminal end of the neck strap 18 includes a cooperative third hook and loop fastener strip 19 to secure the strap 18 about an individual's neck and as illustrated, the strap 18 is mounted to each lateral side of the sheet 13 in alignment with the lower terminal end edge of the sheet 13. FIG. 6 illustrates the use of a selectively mounted further sheet member **13*a* employing the same optical characteristics of the sheet 13 wherein the selectively employed modified sheet 13*a* is of a continuous generally tubular construction and when mounted to the first hook and loop fastener strip 15**, provides a protective envelope about individual to protect individual from insects during a sporting event.

Figure 7:
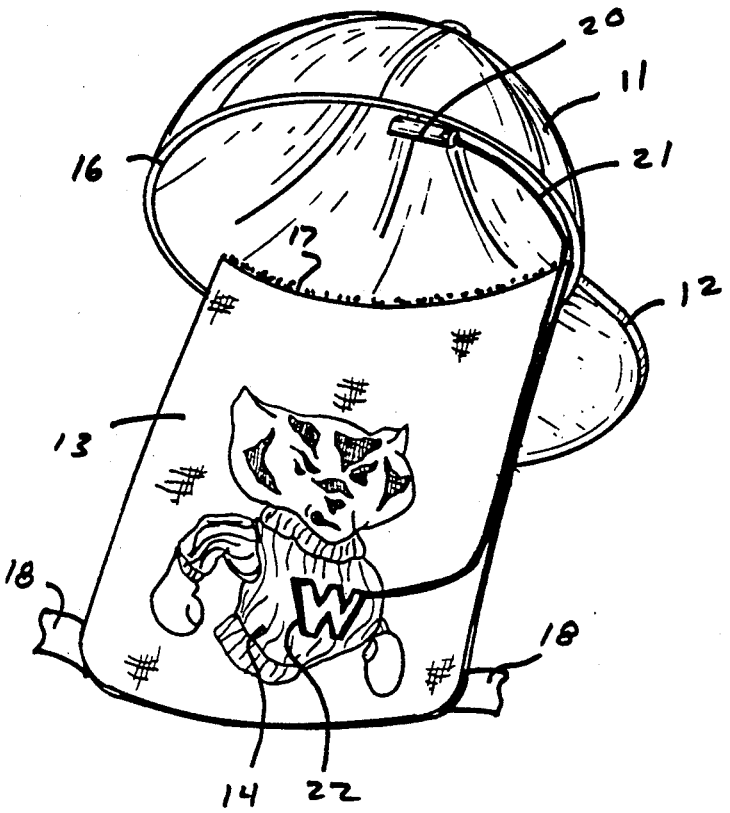
FIG. 7 is an isometric illustration of the instant invention utilizing a fiber optic highlighting device.
Figure 8:
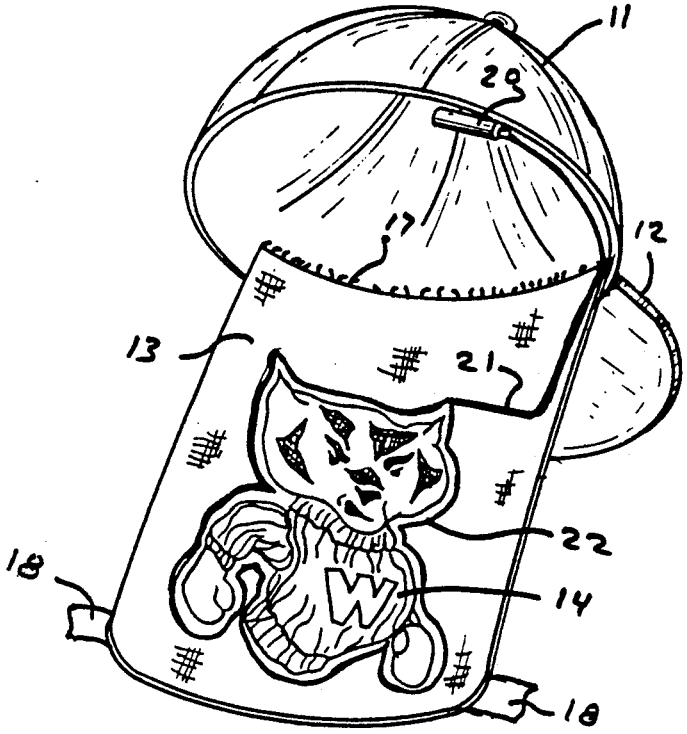
FIG. 8 is a further example of the fiber optic highlighting device as set forth in FIG. 7 in a framework relationship relative to an associated pattern mounted upon the sheet member.

FIGS. 7 and 8 illustrate the cap and mask organization of the instant invention employing initially a battery and illumination source mounted to the lower edge 16 spaced from the first hook and loop fastener strip 15 and including a fiber optic cable 21 in operative association therewith to direct illumination along the fiber optic cable into an associated fiber optic cable pattern 22 mounted about and in association with the pattern 14. FIG. 8 illustrates the fiber optic pattern 22 mounted in a framework relationship relative to the pattern 14 to enhance and accent visual projection of the pattern 14 during conditions of lesser available light.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A cap and mask organization, comprising, a bowl shaped cap member, the cap member including a continuous cap member lower edge, and the cap member including a visor member defined by a predetermined width extending forwardly of the cap member adjacent the lower edge, and an open mesh optically transparent sheet selectively securable to the cap member in alignment with the visor, and the sheet further including a pattern imposed upon the sheet, wherein the pattern retains the outwardly transparent characteristic of the sheet, and wherein the cap member includes a first hook and loop fastener strip mounted to an interior surface of the cap member adjacent to and in contiguous relationship to the lower edge, wherein the first hook and loop fastener strip is defined by a predetermined length, and the first hook and loop fastener strip is arranged with the visor medially oriented to and bisecting the first hook and loop fastener strip, and the sheet including an upper terminal edge, the upper terminal edge including a second hook and loop fastener strip integrally mounted thereto, wherein the second hook and loop fastener strip is selectively securable to the first hook and loop fastener strip and is defined by a second hook and loop fastener strip length equal to the predetermined length, and including a split neck strap mounted in alignment with a lower terminal edge of the sheet and projecting orthogonally relative to spaced lateral sides of the sheet, and the split lower neck strap including a third hook and loop fastener strip mounted to each free terminal end of the neck strap to provide selective securement of the neck strap about an individual's neck and maintain alignment of the sheet relative to the cap member.

2. Apparatus as set forth in claim 1 including a battery and illumination source mounted to the lower edge of the cap member spaced from the first hook and loop fastener strip, and the battery illumination source in operative communication with a fiber optic cable, the fiber optic cable directed along the lower edge of the cap member and is directed about the pattern of the sheet wherein the fiber optic cable defines a continuous fiber optic cable pattern about the pattern formed on the sheet to enhance visual observation of the pattern during limited light conditions.

3. A cap and mask organization as set forth in claim 2 including a further sheet wherein the further sheet is defined as a tubular member and wherein the tubular member is selectively securable to the first hook and loop fastener strip to define an envelope effecting protection to an individual.

* * * * *